US005146935A

United States Patent [19]

Rumore et al.

[11] Patent Number: 5,146,935

[45] Date of Patent: Sep. 15, 1992

[54] FINGERNAIL REPAIR METHOD

[75] Inventors: Lynn Rumore, 73 Cromer Rd., Elmont, N.Y. 11003; Dolores Sapienza, Franklin Square, N.Y.

[73] Assignee: Lynn Rumore, Lake Ronkonkoma, N.Y.

[21] Appl. No.: 666,201

[22] Filed: Mar. 7, 1991

[51] Int. Cl.[5] ..... A45D 29/00

[52] U.S. Cl. ..... 132/73

[58] Field of Search ..... 132/73, 73.5, 285

[56] References Cited

U.S. PATENT DOCUMENTS

| | | | |
|---|---|---|---|
| 2,209,408 | 7/1940 | Litt | 132/73 |
| 3,037,514 | 6/1962 | Lappe | 132/73 |
| 3,228,404 | 1/1966 | Turner | 132/73 |
| 3,982,551 | 9/1976 | Bartolucci | 132/73 |
| 4,299,243 | 11/1981 | Umstattd | 132/73 |
| 4,536,426 | 8/1985 | Massey | 132/73 |
| 4,596,260 | 6/1986 | Giuliano | 132/73 |
| 4,671,305 | 6/1987 | Mann | 132/73 |
| 4,805,645 | 2/1989 | Schiff et al. | 132/73 |
| 4,913,173 | 4/1990 | Hokama et al. | 132/73 |
| 4,960,138 | 10/1990 | Kling | 132/73 |
| 5,005,595 | 4/1991 | Aylott | 132/73 |

OTHER PUBLICATIONS

New Nail Care Techniques, pp. 1-3.

Advertisement: Scotch Brand Cellophane Tape, 1949.

*Primary Examiner*—Gene Mancene

*Assistant Examiner*—Frank A. LaViola

*Attorney, Agent, or Firm*—Michael I. Kroll

[57] ABSTRACT

Fingernail repair patches are provided and consists of a plurality of different sized and molded nail patches. Each nail patch is ready to fit any damaged fingernail then glue is applied to the fingernail, so that the nail patch can cover and reinforce a damaged area to be mended, thus allowing any type of wrap to be applied over the nail patch.

1 Claim, 2 Drawing Sheets

FINGERNAIL REPAIR METHOD

BACKGROUND OF THE INVENTION

1. Field of the Invention

The instant invention relates generally to artificial fingernails and more specifically it relates to fingernail repair patches and method of application.

2. Description of the Prior Art

Numerous artificial fingernails have been provided in prior art that are adapted to be attached directly to human nails by adhesive or glue so that the artificial fingernails will stick thereto to cover the human nails. While these units may be suitable for the particular purpose to which they address, they would not be as suitable for the purposes of the present invention as heretofore described.

SUMMARY OF THE INVENTION

A primary object of the present invention is to provide fingernail repair patches and method of application that will overcome the shortcomings of the prior art devices.

Another object is to provide fingernail repair patches and method of application that includes a plurality of different sized and molded nail patches carried in a container, each to be used to repair a different type of damaged nail.

An additional object is to provide fingernail repair patches and method of application in which each nail patch can be applied to a different type of damaged nail, so as to reinforce the damaged area when glue is applied before and any type of wrap is applied after the nail patch is applied.

A further object is to provide fingernail repair patches and method of application that is simple and easy to use.

A still further object is to provide fingernail repair patches and method of application that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 2:
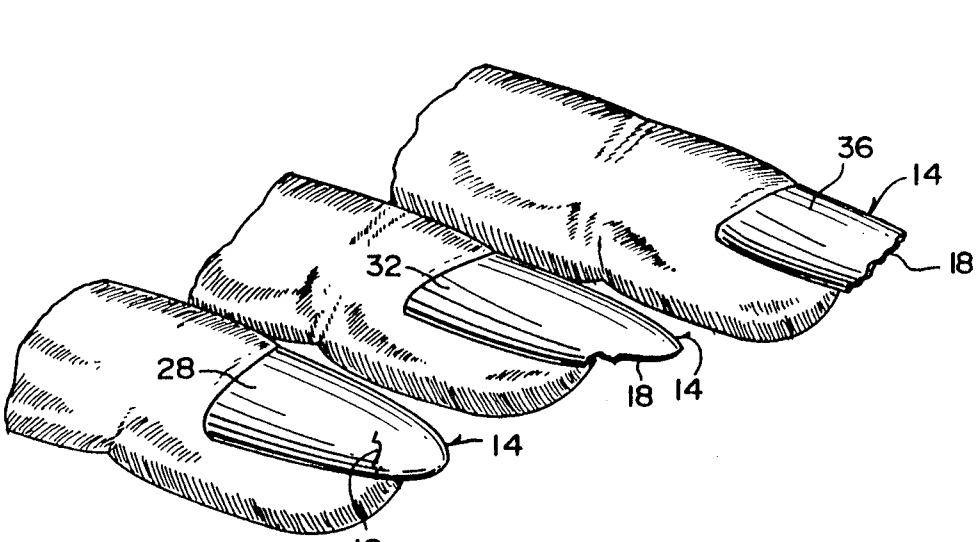
FIG. 2 is an enlarged perspective view of three fingers showing the fingernail damage in greater detail.
Figure 1:
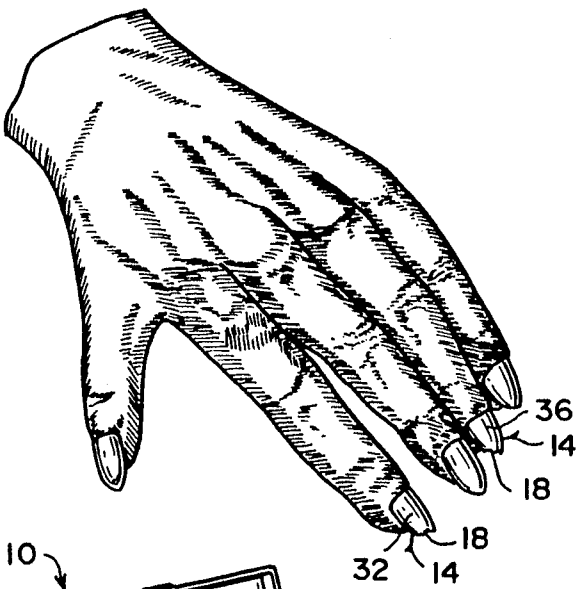
FIG. 1 is a perspective view of a hand showing typical fingernail damage.
Figure 3:
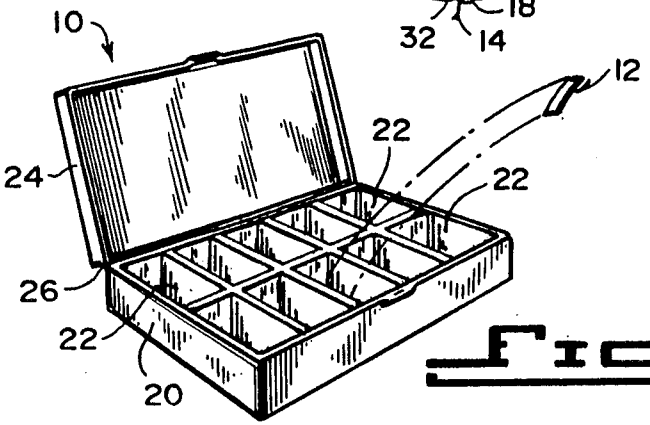
FIG. 3 is a perspective view of the instant invention.

Turning now descriptively to the drawings, in which similar reference characters denote similar elements throughout the several views, the Figures illustrate fingernail repair patches 10 which consists of a plurality of different sized and molded nail patches 12. Each nail patch 12 is ready to fit any damaged fingernail 14 after glue 16 is applied to the fingernail 14, so that the nail patch 12 can cover and reinforce a damaged area 18 to be mended, thus allowing any type of wrap 19 to be applied over the nail patch 12.

The fingernail repair patches 10 further includes a container 20 having a plurality of compartments 22 for carrying the nail patches 12 therein so as to be ready for use. A lid 24 is hinged at 26 to the container 20 for covering the nail patches 12 within the compartment 22 so as to protect the nail patches 12 before use.

Figure 5:
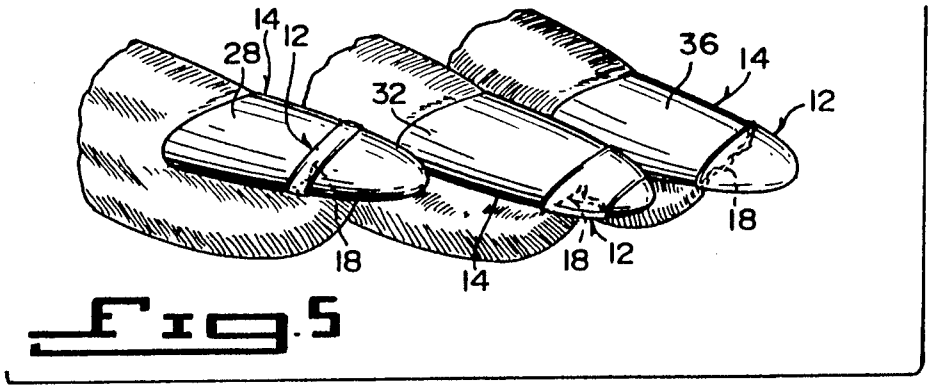
FIG. 5 is an enlarged perspective view similar to FIG. 2, showing the nail patch applied to the damaged fingernails.
Figure 7:
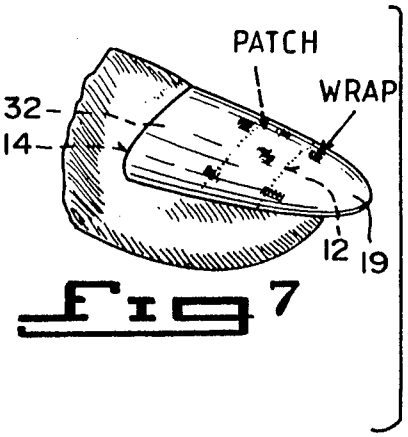
FIG. 7 is a perspective view showing a wrap applied over the nail patch.

As best shown in FIGS. 2 and 5, when the damaged fingernail 14 is of a cracked fingernail type 28, the nail patch 12 will be sized and molded to cover the damaged area 18. When the damaged fingernail 14 is of a chipped fingernail type 32, the nail patch 12 will be sized and molded to cover the damaged area 18. When the damaged fingernail 14 is of a broken fingernail type 36, the nail patch 12 will be sized and molded to cover the damaged area 18. Only one size nail patch 12 is supplied for each finger, such as thumb, index, middle, ring and pinky and will take care of all three different types of damaged fingernails 14.

To repair the damaged fingernail 14, the following steps are to be taken:

1. Inspect the fingernail 14 to determine the type and extent of damage;
2. Select the appropriate sized and molded nail patch 12 from the fingernail repair patches 10 that will be applied to the damaged fingernail 14.
3. Remove the appropriate nail patch 12 from the fingernail repair patches 10.
4. Apply the glue 16 directly to the damaged fingernail 14.
5. Apply the nail patch 12 to the area of damage 18 on the fingernail 14.
6. File the nail patch 12 into the material of the natural nail 14 by using a nail file 40.
7. Apply the wrap 19 over the nail patch so that the nail patch 12 will enhance the strength of the wrap 19.

The nail patch 12 is fabricated out of a polymer plastic material, or any other suitable material and is textured and has a slight pigmentation to simulate the appearance of the contents of the material of the natural nail 14.

The glue 16 used with the present invention is preferably dispensed from a dropper type container or tube 42 designed to produce at least one drop for each nail patch 12.

The wrap 19 may be made of silk or any other thin flexible strong material that will be reinforced by the nail patch 12.

Figure 6:
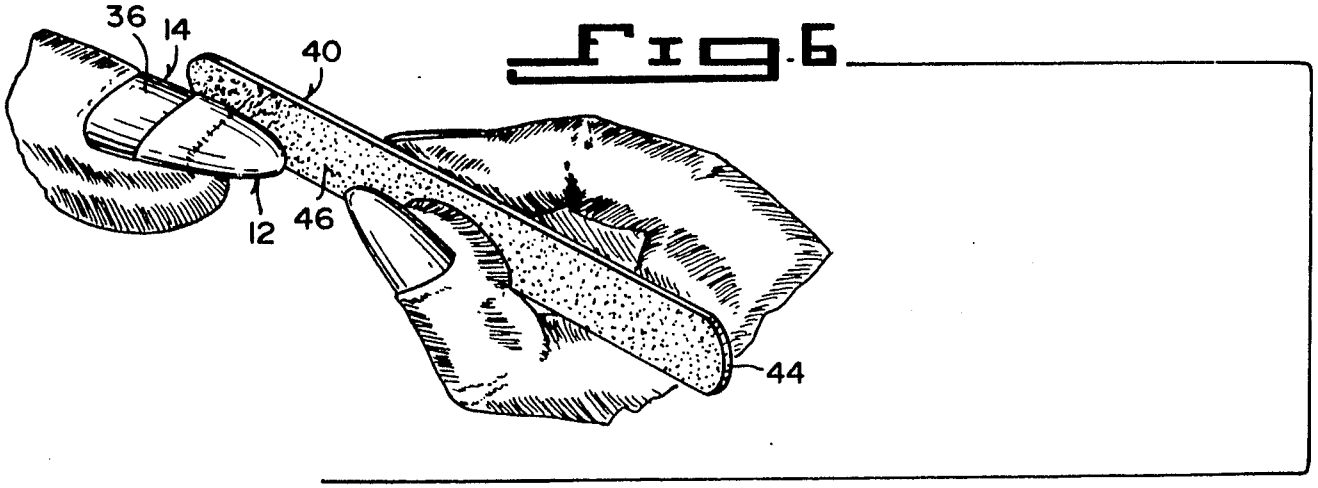
FIG. 6 is a perspective view showing one of the nail patches being filed.
Figure 4:
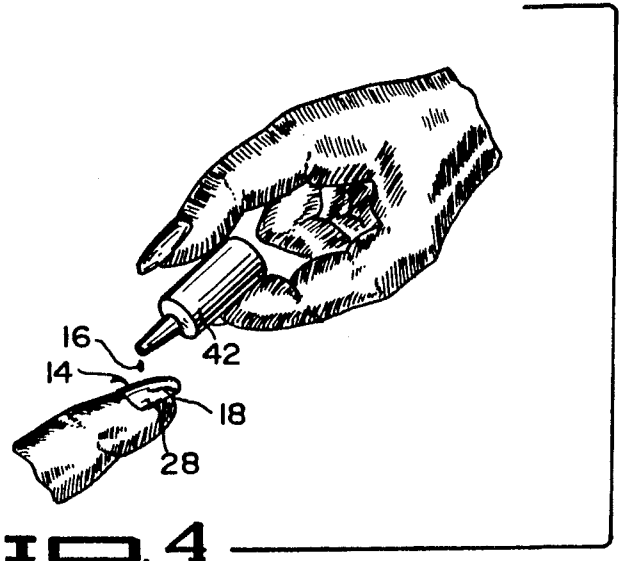
FIG. 4 is a perspective view showing glue being applied to a damaged fingernail.

As shown in FIG. 6, the nail file 40 which is any suitable filing tool, generally consists of a strip of wood 44 coated with a suitable abrasive 46, while in other instances a metal strip file may be employed.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method for repairing a damaged natural fingernail, comprising the steps of:

a) inspecting the natural fingernail to determine the type and extent of the damage;

b) selecting an appropriately sized and molded nail patch from a group of fingernail repair patches, said selected nail patch being of a size to cover only the damaged portion of the fingernail;

c) removing the appropriate nail patch from the group of fingernail repair patches;

d) applying only one layer of glue directly to the damaged portion of the fingernail;

e) applying the selected nail patch to the damaged portion of the fingernail;

f) filing the nail patch into the material of the natural fingernail; and g) applying a wrap over the nail patch so that the nail patch will enhance the strength of the wrap.

* * * * *